US010428543B2

(12) United States Patent
Suri et al.

(10) Patent No.: US 10,428,543 B2
(45) Date of Patent: Oct. 1, 2019

(54) ENDLESS POOL ASSEMBLY

(71) Applicants: Harcharan Suri, Troy, MI (US); Martin Proctor, Vassar, MI (US)

(72) Inventors: Harcharan Suri, Troy, MI (US); Martin Proctor, Vassar, MI (US)

( * ) Notice: Subject to any disclaimer, the term of this patent is extended or adjusted under 35 U.S.C. 154(b) by 0 days.

(21) Appl. No.: 15/728,289

(22) Filed: Oct. 9, 2017

(65) Prior Publication Data

US 2018/0100320 A1 Apr. 12, 2018

Related U.S. Application Data

(60) Provisional application No. 62/405,759, filed on Oct. 7, 2016.

(51) Int. Cl.
*E04H 4/12* (2006.01)
*E04H 4/14* (2006.01)

(52) U.S. Cl.
CPC ..... *E04H 4/12* (2013.01); *E04H 4/144* (2013.01)

(58) Field of Classification Search
CPC ..... E04H 4/12; E04H 4/14
USPC ..... 4/492, 494, 496, 507, 904
See application file for complete search history.

(56) References Cited

U.S. PATENT DOCUMENTS 4,001,899 A * 1/1977 Mathis ..... A63B 69/12 4/904
5,228,148 A * 7/1993 Weir ..... E04H 4/14 4/496
7,971,286 B2 * 7/2011 Dillen, II ..... E04H 4/144 4/492
7,975,327 B2 * 7/2011 Switzer ..... A47B 37/04 4/496
8,272,078 B2 * 9/2012 Snow ..... E04H 4/1218 4/507
8,702,387 B2 * 4/2014 Gillette ..... A63B 69/125 4/904
2010/0300548 A1 * 12/2010 DeVerse ..... E04H 4/12 137/1

* cited by examiner

*Primary Examiner* — Tuan N Nguyen
(74) *Attorney, Agent, or Firm* — Craig A. Phillips; Dickinson Wright PLLC

(57) ABSTRACT

A pool assembly is provided. The pool assembly includes a pool body defining a pool cavity for containing water. The pool body includes an injection manifold disposed in an inlet wall of the pool body for providing a flow of water into the pool body. An ejection manifold is disposed in an exit wall of the pool body for removing the flow of water from the pool body. Removable plates attach to the manifolds for altering the flow of water. A stairway and seat subassembly is constructed of mesh is disposed adjacent the exit wall to allow water to flow therethrough.

31 Claims, 10 Drawing Sheets

ENDLESS POOL ASSEMBLY

CROSS-REFERENCE TO RELATED APPLICATIONS

This utility application claims the benefit of U.S. Provisional Application No. 62/405,759 filed Oct. 7, 2016. The entire disclosure of the above application is incorporated herein by reference.

FIELD

The present disclosure relates to a pool assembly.

BACKGROUND

This section provides background information related to the technology associated with the present disclosure and, as such, is not necessarily prior art.

Endless pools provide users with the opportunity to swim or otherwise exercise while making it possible to install the pool in a small area as compared to an area commonly required for a traditional pool. Such endless pools generally use at least one pump to create a flow of water (i.e., a current) within the pool, from one end of the pool to the other. Thus, the user of the pool can swim against the flow or current, simulating the swimming of laps in a traditional pool, for example.

However, such a flow or current must be very strong in most cases to provide for exercises in the pool. This strong current can limit the use of the pool while it is being operated to create the current. More specifically, the strong current throughout the pool can deter others in the pool, who may desire to simply remain stationary from enjoying the pool. Additionally, the strong current can potentially restrain users and/or objects in the pool near the area in which water from the flow or current exits the pool. Furthermore, the strong current can lead to design challenges in arranging structures such as ladders, seats, and/or stairs in the pool without significantly impeding the flow of water from one end of the pool to the other. Accordingly, there is an increasing need for improved pool assemblies.

SUMMARY

This section provides a general summary of some aspects, features and advantages provided by or associated with the inventive concepts hereinafter disclosed in accordance with the present disclosure and is not intended to be a comprehensive summation and/or limit the interpretation and scope of protection afforded by the claims.

According to aspects of the disclosure, a pool assembly is provided. The pool assembly includes a pool body having a floor and a first side wall and a second side wall extending generally parallel to one another and each extending upwardly from the floor. The pool body also includes an inlet wall and an exit wall each extending between the first side wall and the second side wall upwardly from the floor to define a pool cavity for containing water. The pool body includes an injection manifold disposed in the inlet wall for providing a flow of water into the pool cavity and an ejection manifold disposed in the exit wall for removing the flow of water from the pool cavity. The flow of water is generally centered in the pool cavity and spaced from the side walls to allow for the water in the pool cavity to remain substantially stationary adjacent the side walls. A stairway and seat subassembly is disposed in the pool cavity and is porous for allowing the flow of water to pass through the stairway and seat subassembly.

According to another aspect of the disclosure, a seat and stairway subassembly for a pool assembly is also provided. The seat and stairway subassembly includes a stairway portion including a plurality of steps of decreasing height and being porous for allowing a passage of water through the stairway portion. The seat and stairway subassembly additionally includes a seat portion disposed adjacent the stairway portion and including a plurality of seating platforms of decreasing height. The seat portion is also porous for allowing a passage of water through the seat portion.

Further areas of applicability will become apparent from the description provided herein. The description and specific examples in this summary are only intended for purposes of illustration and are not intended to limit the scope of the present disclosure.

DRAWINGS

The drawings described herein are for illustrative purposes only of selected embodiments and not all possible or anticipated implementations thereof, and are not intended to limit the scope of the present disclosure.

Figure 1:
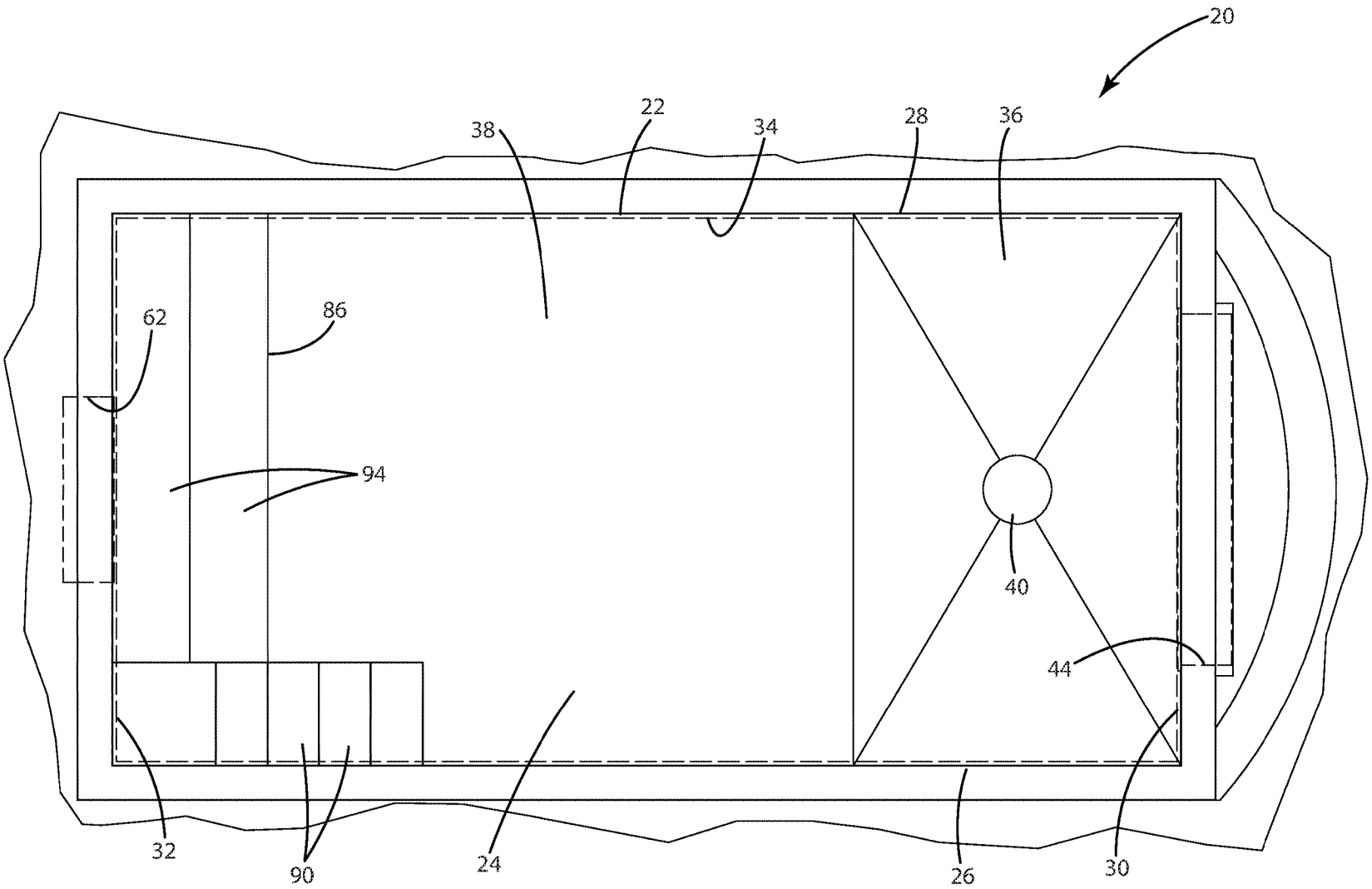
FIG. 1 is a top view of a pool assembly according to aspects of the disclosure.
Figure 2:
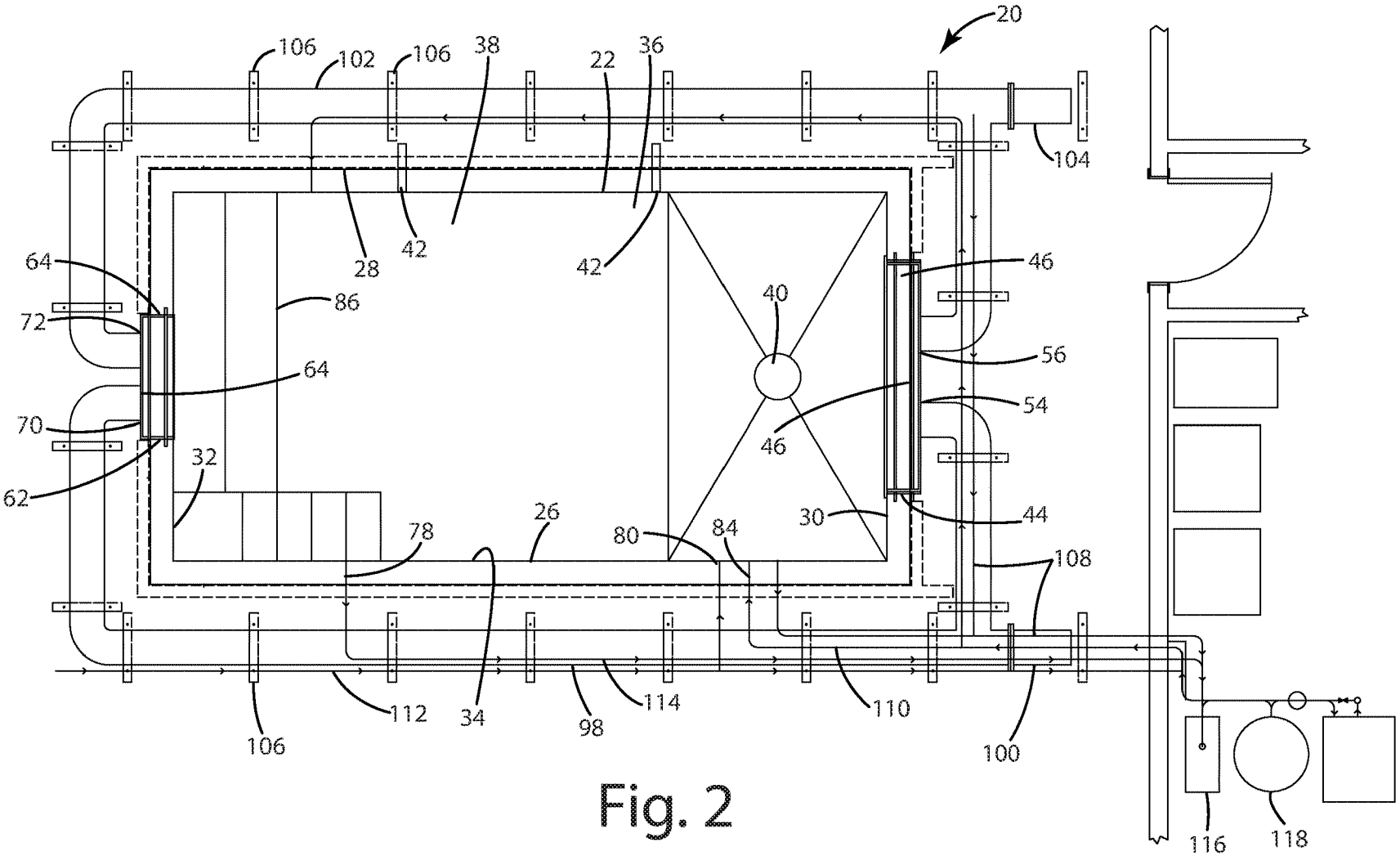
FIG. 2 is a top view of a pool assembly according to aspects of the disclosure.
Figure 13A:
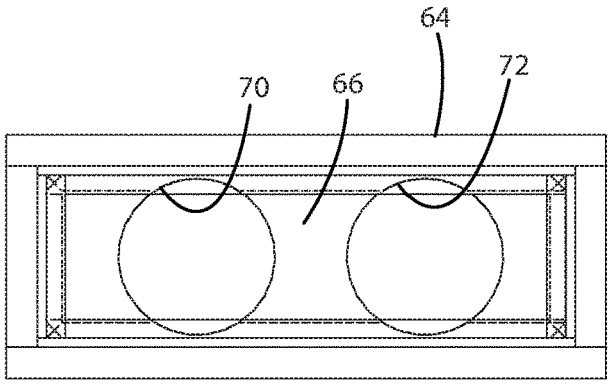
Figure 13B:
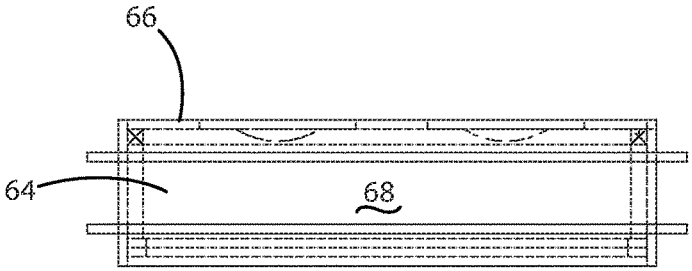
Figure 13C:
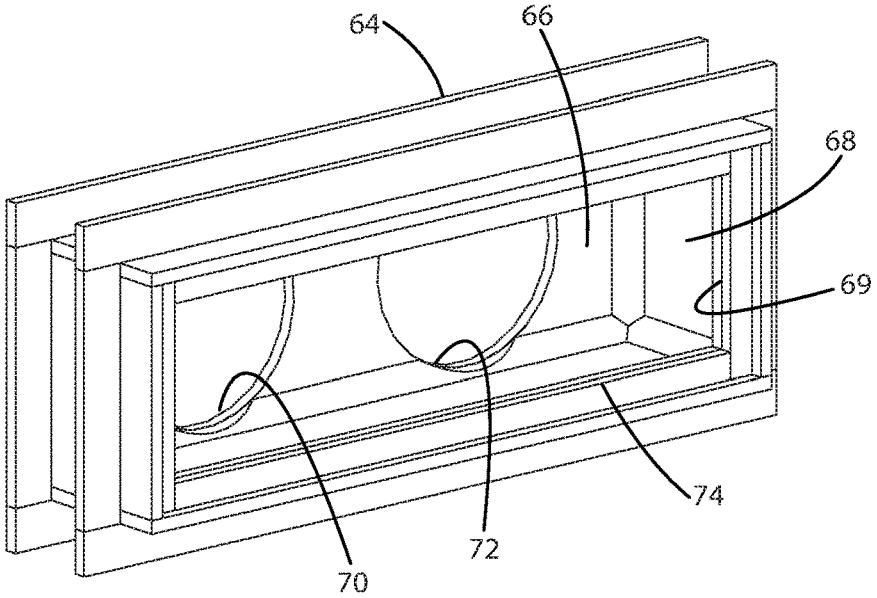

FIGS. 10A-10C, 11A-11C, and 12 illustrate inlet flow plates of the pool assembly of FIG. 2 according to aspects of the disclosure; and FIGS. 13A-13C illustrate an ejection manifold of the pool assembly of FIG. 2 according to aspects of the disclosure.

Corresponding reference numbers indicate correspondent components throughout the several views of the drawings.

DETAILED DESCRIPTION

Example embodiments will now be described more fully with reference to the accompanying drawings. In general, a pool assembly will be disclosed that is considered to be adaptable, with or without modifications. More specifically, the disclosed pool assembly incorporates a porous stair and seat subassembly, and injection and ejection manifolds with removable flow plates. To this end, example embodiments of the pool assembly will be described. However, the example embodiments are solely provided so that this disclosure will be thorough, and will fully convey its intended scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, wherein like numerals indicate corresponding parts throughout the several views, a pool assembly 20 constructed in accordance with aspects of the disclosure is provided. As best shown in FIGS. 1-5, the pool assembly 20 includes a pool body 22 having a floor 24 and a first side wall 26 and a second side wall 28. The first side wall 26 and the second side wall 28 extend upwardly from the floor 24 and are generally parallel to one another. The pool body 22 further includes an inlet wall 30 and an exit wall 32 each extending upwardly from the floor 24 opposite one another and between the first side wall 26 and the second side wall 28. The first side wall 26 and second side wall 28 and inlet wall 30 and exit wall 32 and floor 24 define a pool cavity 34 for holding water.

Figure 3:
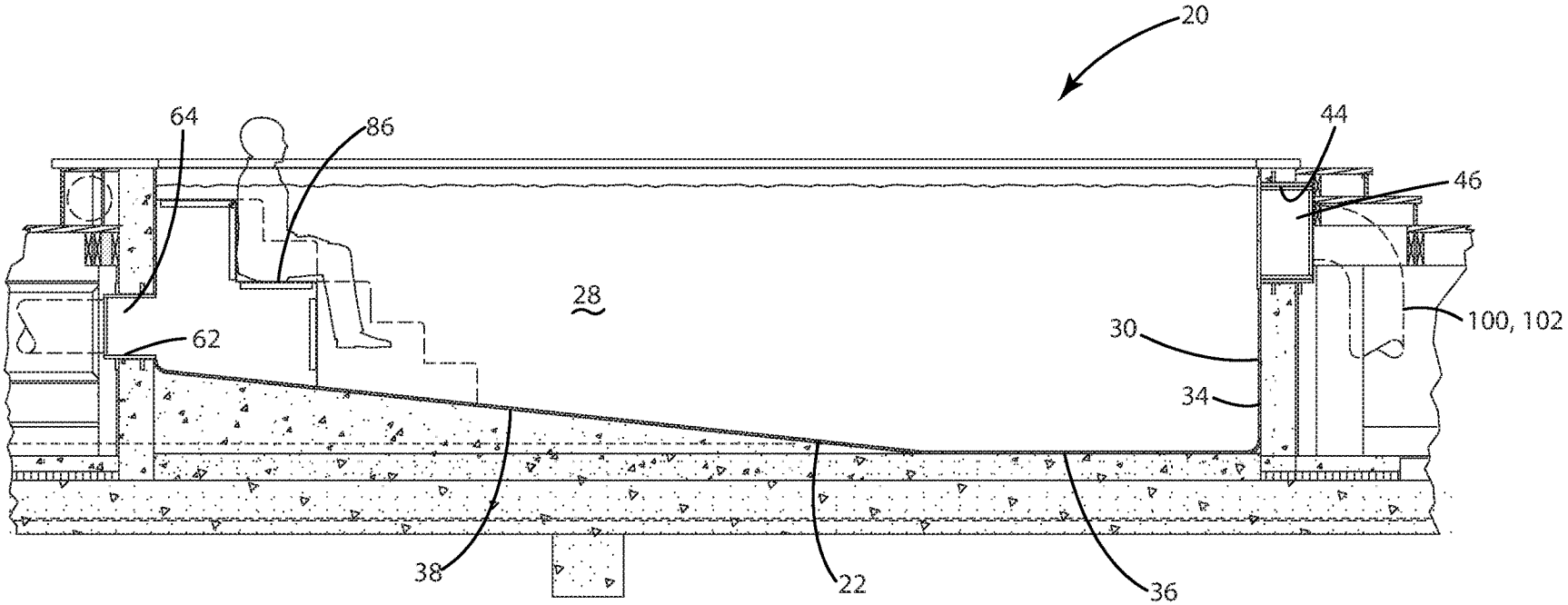
FIG. 3 is a side cross-sectional view of the pool assembly of FIG. 2.

The floor 24 includes a first region 36 adjacent the inlet wall 30 that is generally flat and a second region 38 that is inclined downwardly from the exit wall 32 toward the first region 36 (FIG. 3). The floor 24 also can define a drain aperture 40 disposed in the first region 36. The first side wall 26 and the second side wall 28 each define a plurality of light apertures. At least one pool light 42 (FIG. 2) is attached to the pool body 22 and is disposed within the light apertures for lighting the pool cavity 34.

Figure 4:
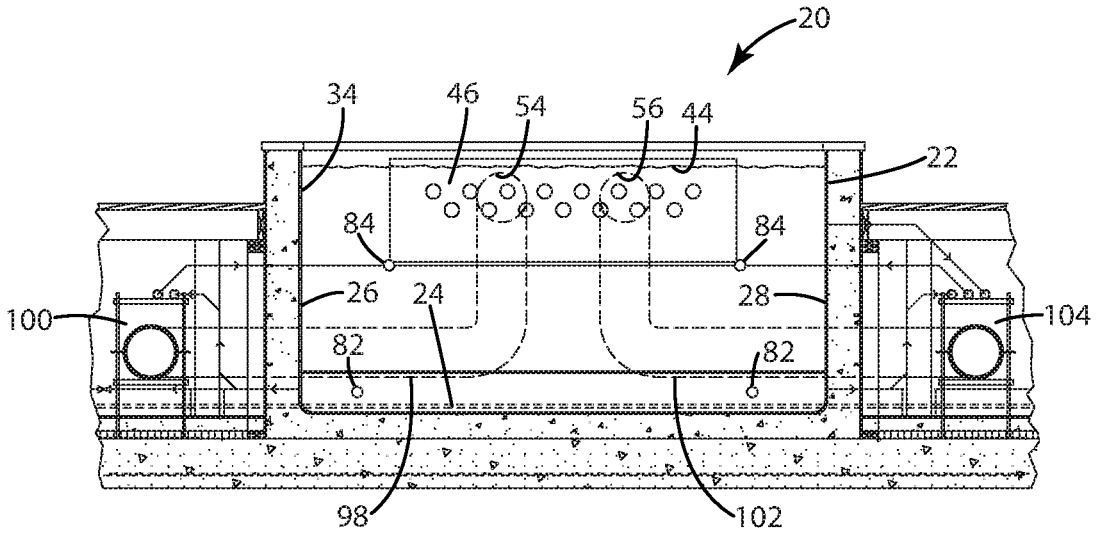
FIG. 4 is an end cross-sectional view of the pool assembly of FIG. 2.
Figure 8A:
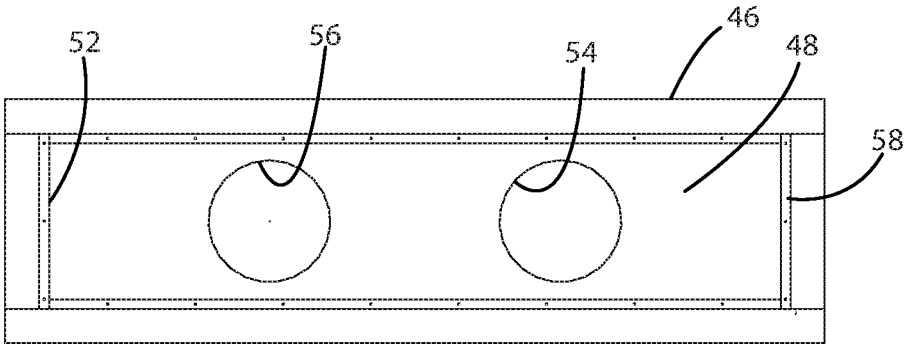
FIGS. 8A-8C illustrate an injection manifold of the pool assembly of FIG. 2 according to aspects of the disclosure.
Figure 8B:
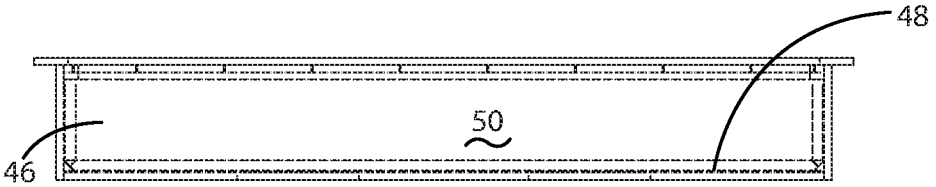
Figure 8C:
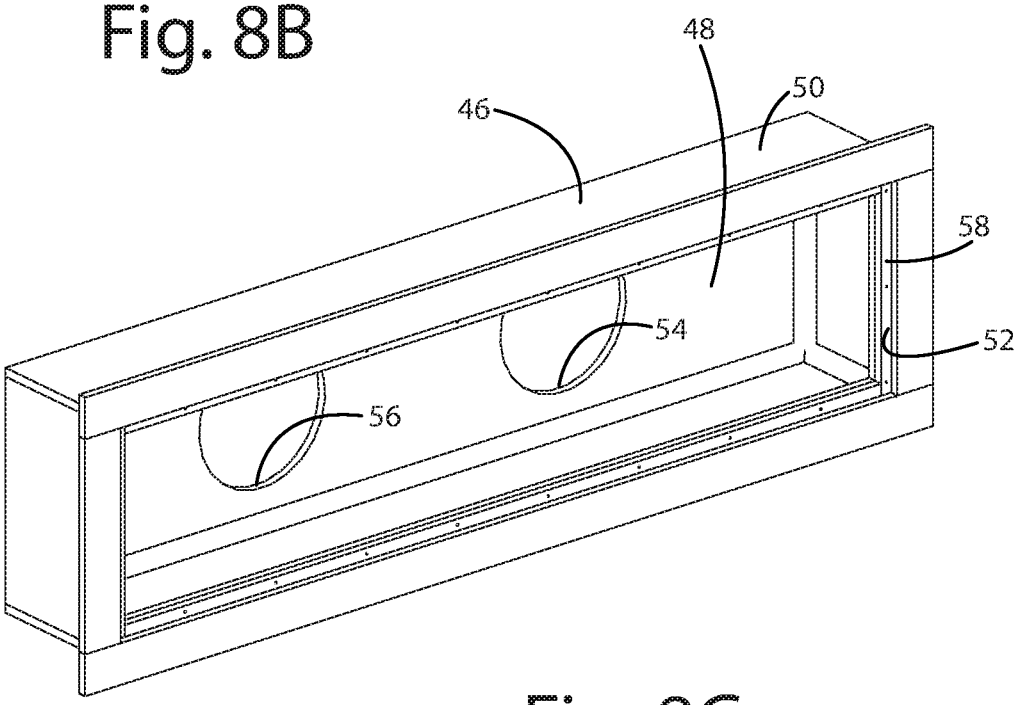
Figure 9A:
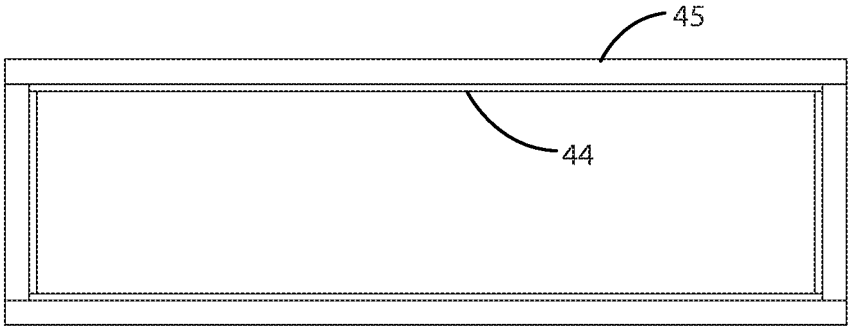
FIGS. 9A and 9B illustrate an injection opening of the pool assembly of FIG. 2 according to aspects of the disclosure.
Figure 9B:
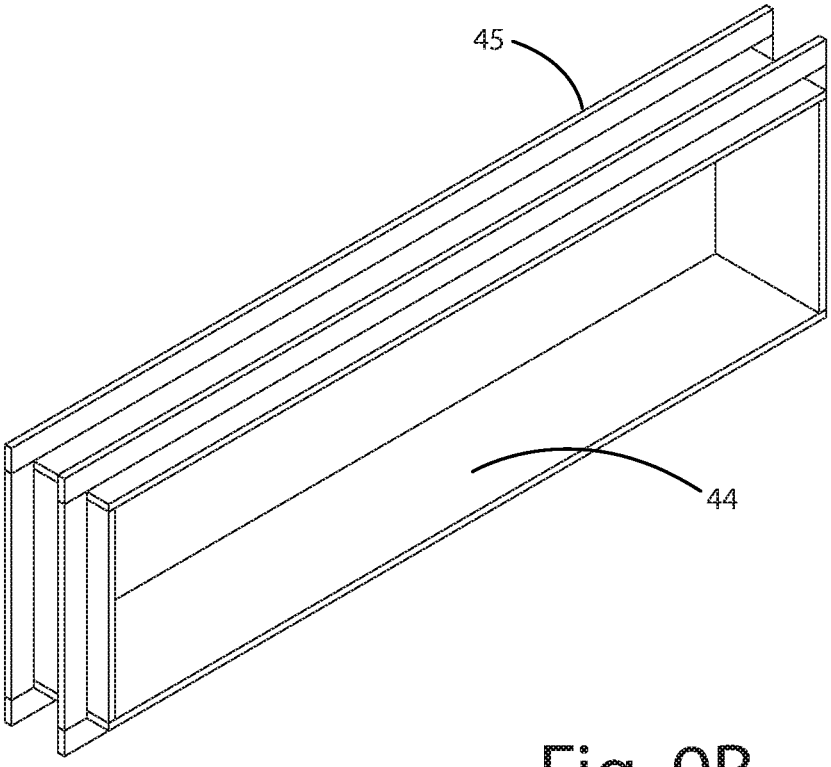
Figure 10A:
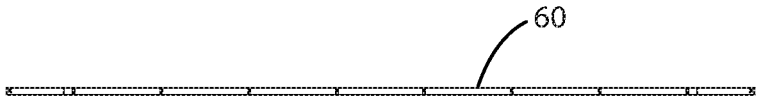
Figure 10B:
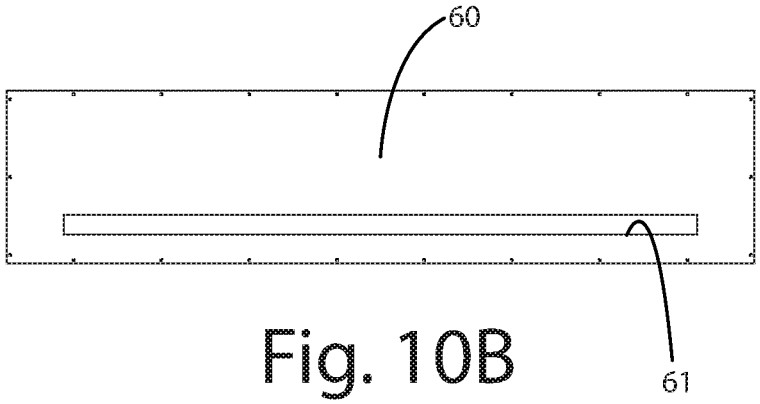
Figure 10C:
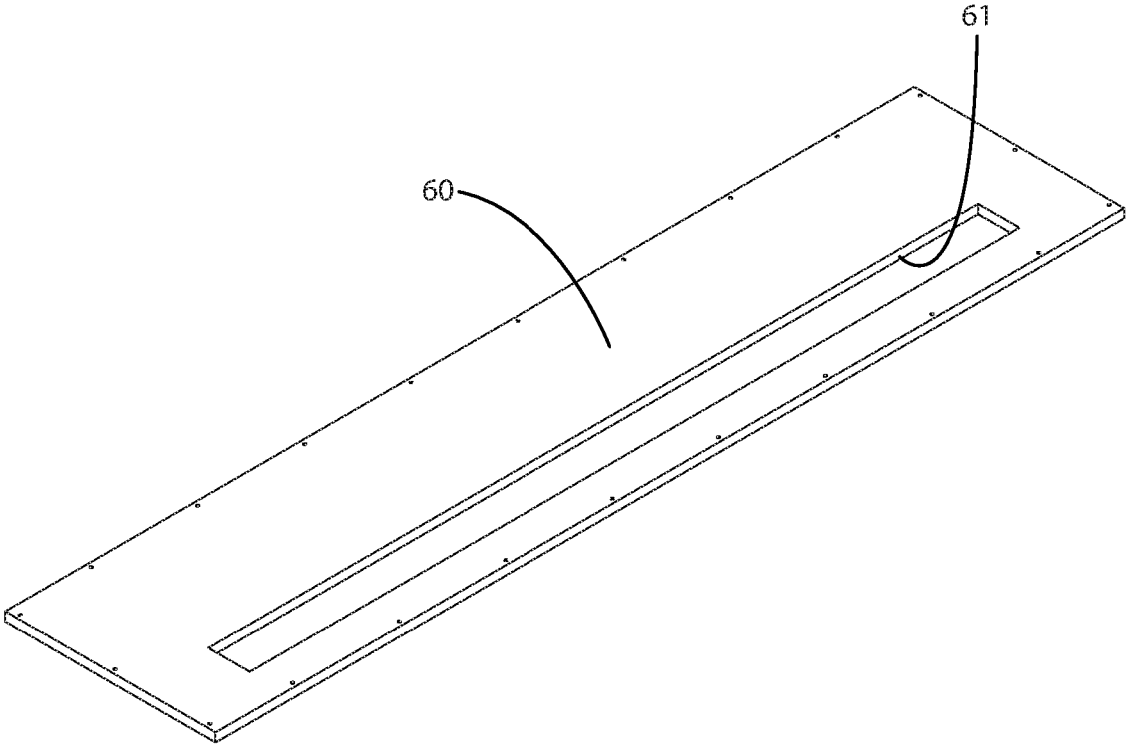
Figure 11A:
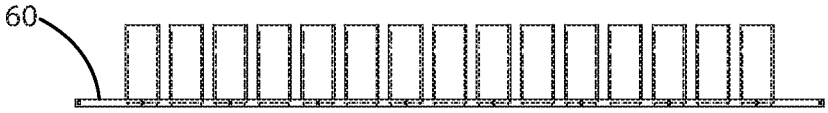
Figure 11B:
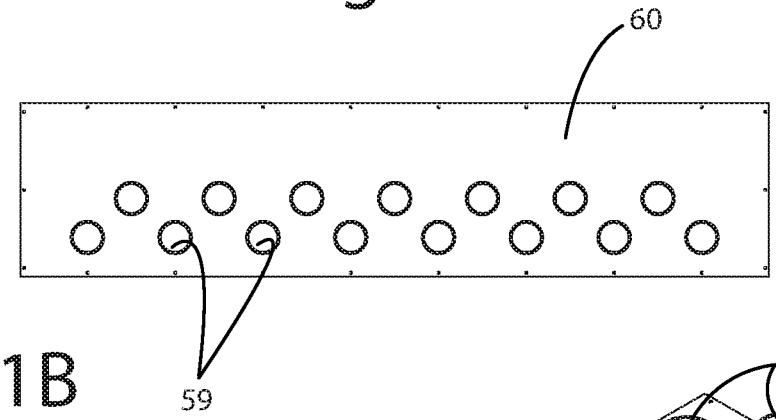
Figure 11C:
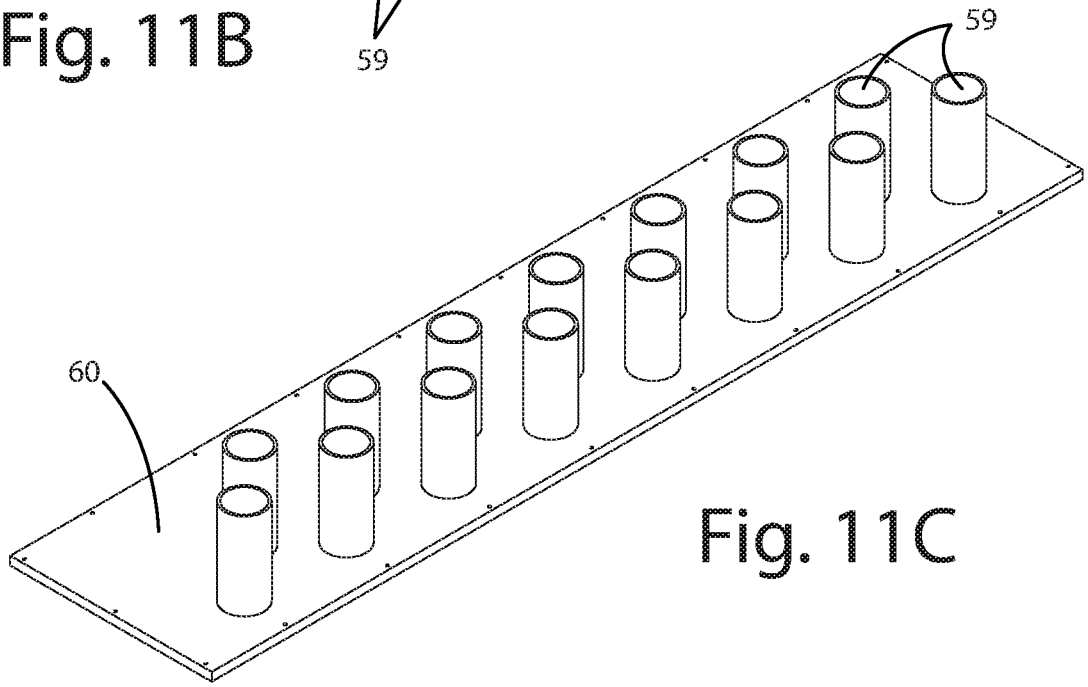
Figure 12:
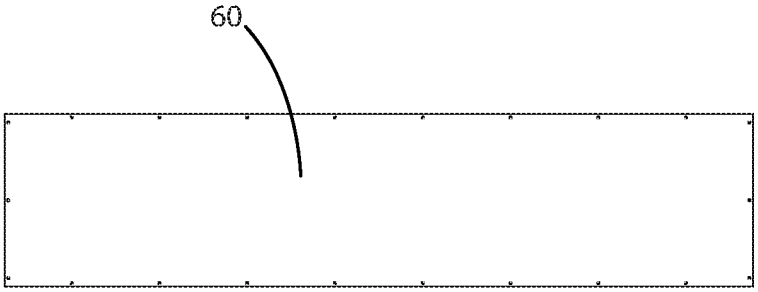

The inlet wall 30 defines an injection opening 44 equally spaced from the first side wall 26 and the second side wall 28 and also adjacent the top of the inlet wall 30 (FIG. 4). The injection opening 44 can be defined by a sleeve 45 (FIGS. 9A-9B) inserted or attached to the inlet wall 30. An injection manifold 46 is attached to the inlet wall 30 and is disposed in the injection opening 44 for providing a flow of water into the pool cavity 34. The injection manifold 46 has an inlet back plate 48 (FIGS. 8A-8C) that is rectangular and an inlet peripheral wall 50 extends circumferentially around the inlet back plate 48 to define an inlet flow opening 52. The inlet back plate 48 of the injection manifold 46 defines a first injection opening 54 and a second injection opening 56 in a spaced relationship with the first injection opening 54. The inlet peripheral wall 50 includes an inlet lip 58 extending around the inlet flow opening 52 in a spaced relationship with the inlet back plate 48 and extending around the inlet peripheral wall 50. At least one inlet flow plate 60 (FIGS. 10A-10C, 11A-11C, and 12) is removably attached to the inlet lip 58 in the inlet flow opening 52 for directing the flow of water through the injection manifold 46. Various configurations of inlet flow plates 60 may be used, such as, but not limited to the at least one inlet flow plate 60 defining a plurality of circular inlet openings 59 extending therethrough (FIGS. 11A-11C) or the at least one inlet flow plate 60 defining an elongated slot 61 extending therethrough (FIGS. 10A-10C). The at least one flow plate 60 may also be stacked with or placed immediately adjacent to another inlet flow plate 60.

Figure 5:
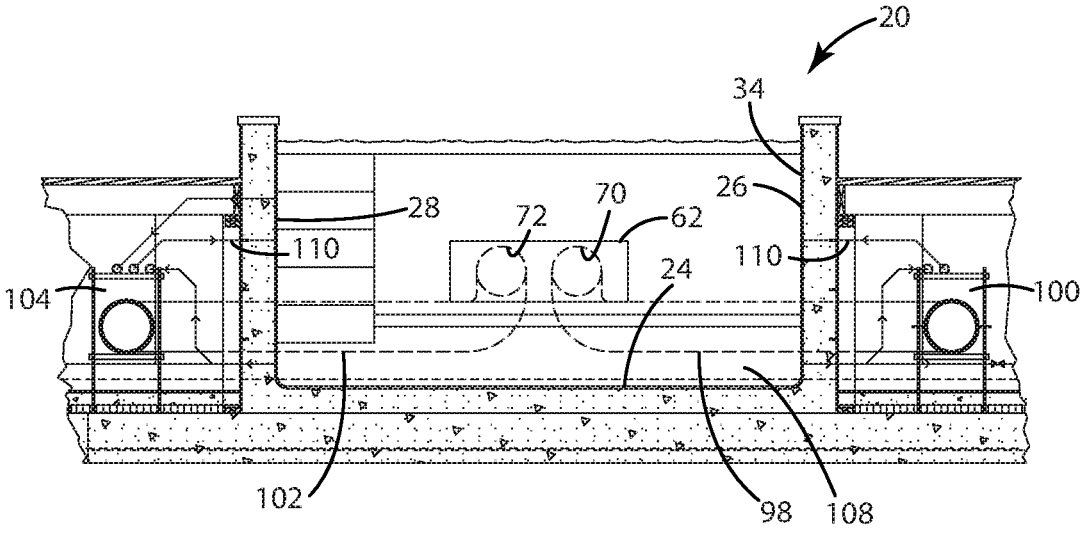
FIG. 5 is an end cross-sectional view of the pool assembly of FIG. 2.
Figure 6:
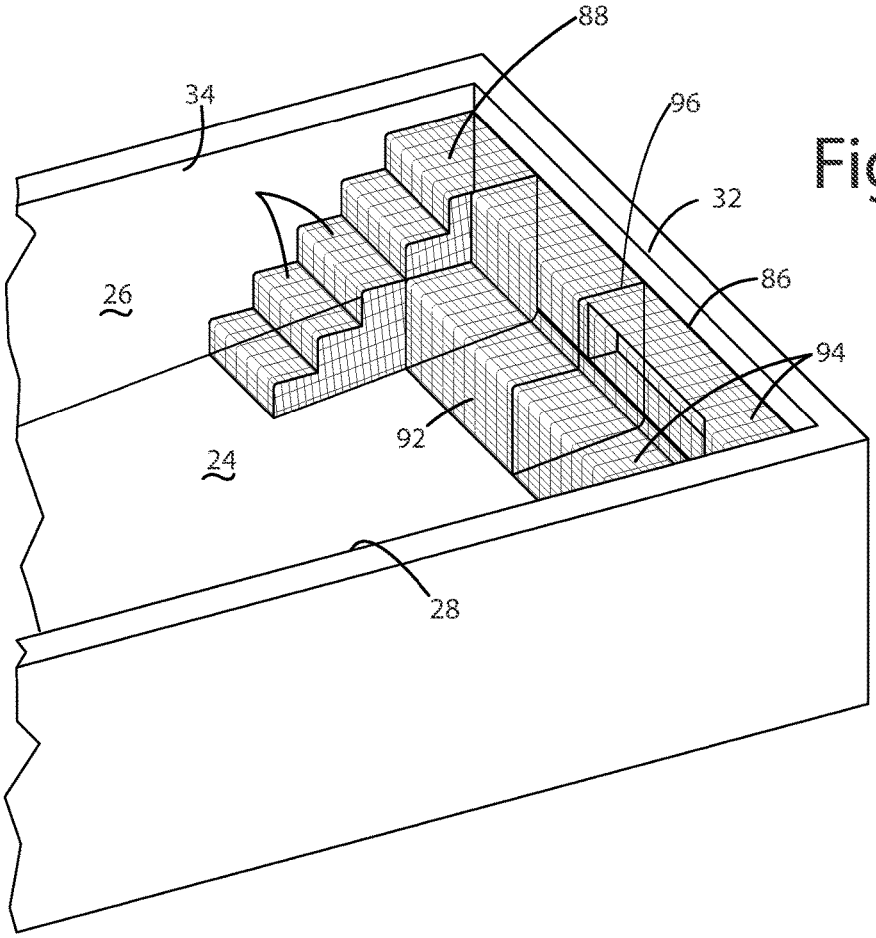
FIG. 6 is a partial perspective view of the pool assembly of FIG. 2 illustrating a stairway and seat subassembly according to aspects of the disclosure.
Figure 7A:
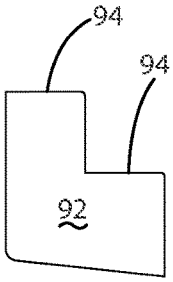
FIGS. 7A-7D illustrate the stairway and seat subassembly of FIG. 6.
Figure 7B:
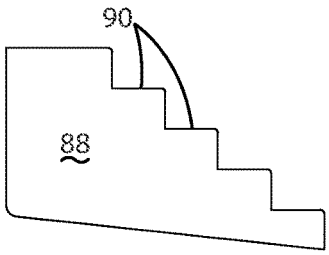
Figure 7C:
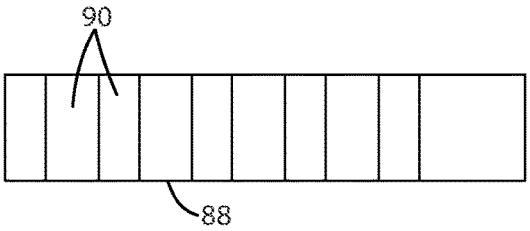
Figure 7D:
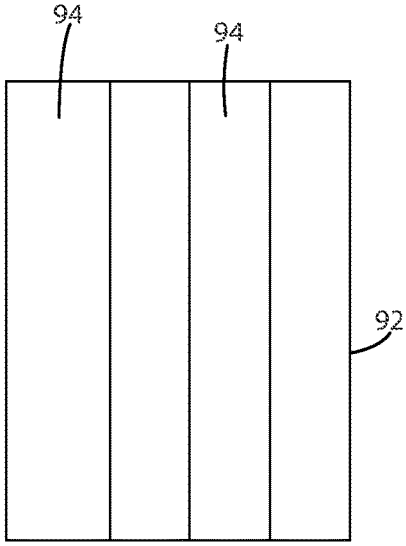

The exit wall 32 defines an ejection opening 62 opposite the injection opening 44 and equally spaced from the first side wall 26 and the second side wall 28 and adjacent the floor 24 (FIG. 5). An ejection manifold 64 attaches to the exit wall 32 and is disposed in the ejection opening 62 for removing the flow of water entering from the injection manifold 46 to create a current of water through the pool cavity 34 from the injection manifold 46 to the ejection manifold 64. Like the injection manifold 46, the ejection manifold 64 has an ejection back plate 66 (FIGS. 13A-13C) that is rectangular and an ejection peripheral wall 68 extending circumferentially around the ejection back plate 66 to define an ejection flow opening 69. The ejection back plate 66 of the ejection manifold 64 defines a first ejection opening 70 and a second ejection opening 72 in a spaced relationship with the first ejection opening 70. The ejection peripheral wall 68 includes an ejection lip 74 extending around the ejection flow opening 69 in a spaced relationship with the ejection back plate 66 and extending around the ejection peripheral wall 68. At least one ejection flow plate (not shown, but can be similar or identical to the at least one inlet flow plate 60 discussed above) is removably attached to the ejection lip 74 in the ejection flow opening for directing the flow of water through the ejection manifold 64. As with the at least one inlet flow plate 60, the at least one ejection flow plate may be stacked or placed immediately adjacent another ejection flow plate.

The arrangement of the injection manifold 46 relative to the ejection manifold 64 provides a current or slipstream that extends from the inlet wall 30 to the exit wall 32 while remaining generally centered in the pool body 22. In other words, the current is spaced from the side walls 26, 28 to allow for the water in the pool cavity 34 to remain substantially stationary off to the sides of the current (i.e., near the side walls 26, 28). Consequently, the occupants that do not desire to be affected by the current can remain near the side walls 26, 28.

The walls 26, 28, 30, 32 of the pool body 22 define at least one skimmer opening. A skimmer 78 (FIG. 2) is disposed in the at least one skimmer opening for removing floating debris from the surface of the water within the pool cavity 34. At least one fill opening 80 and a plurality drain openings 82 and a plurality of return openings 84 are also defined by the walls 26, 28, 30, 32.

As best shown in FIGS. 6 and 7A-7D, a stairway and seat subassembly 86 that is porous is disposed adjacent the exit wall 32 in front of the ejection manifold 64 and extending between the first side wall 26 and the second side wall 28. The stairway and seat subassembly 86 includes a stairway portion 88 that is adjacent the first side wall 26 and has a plurality of steps 90 of decreasing height leading from the exit wall 32 toward the floor 24 (FIG. 3). The stairway and seat subassembly 86 also includes a seat portion 92 that extends from the stairway portion 88 toward the second side wall 28 and includes a plurality of seating platforms 94 (e.g., a pair) of decreasing height leading from the exit wall 32 toward the floor 24. The stairway and seat subassembly 86 is constructed of mesh and defines a plurality of mesh openings to allow a passage of water through the stairway and seat subassembly 86. It should be understood that instead of being mesh, the stairway and seat subassembly 86 could instead be constructed of some other porous material (e.g., ceramic). At least one seat support 96 is coupled to stairway and seat assembly under the seating platforms 94 of the seat portion 92 for supporting the seat portion 92. It should be understood that the stairway and seat subassembly 86 may have any number of steps 90, seat supports 96, and/or seating platforms 94 in various arrangements (e.g., using the seat portion 92 as stairs without the stairway portion 88 or only including the stairway portion 88).

Such a stairway and seat subassembly 86 provides for water to flow substantially unimpeded through the pool cavity 34 from the injection manifold 46 to the ejection manifold 64. Because the entire stairway and seat subassembly 86 is porous, occupants or users of the pool may be on the stairway portion 88 and/or the seat portion 92 without preventing the flow of the water around them and through the stairway and seat assembly 86 to move into the ejection manifold 64. While the stairway and seat subassembly 86 is shown extending the width of the pool cavity 34, it should be appreciated that the stairway and seat subassembly 86 may extend only partially across the width or even be located elsewhere in the pool cavity 34 (e.g., against one of the side walls 26, 28 or against the inlet wall 30). In addition, the stairway and seat subassembly 86 could also be constructed as multiple pieces and may be removable from the pool cavity 34.

Referring back to FIG. 2, a first main flow pipe 98 extends along the pool body 22 outside of the pool cavity 34 from the first injection opening 54 of the injection manifold 46 to the first ejection opening 70 of the ejection manifold 64 for providing fluid communication between the injection manifold 46 and the ejection manifold 64. A first inline pump 100 connects to the first main flow pipe 98 to move water from the injection manifold 46 through the pool cavity 34 to the ejection manifold 64 and back to the injection manifold 46. Similarly, a second main flow pipe 102 extends along the pool body 22 outside of the pool cavity 34 from the second injection opening 56 of the injection manifold 46 to the second ejection opening 72 of the ejection manifold 64 for providing fluid communication between the injection manifold 46 and the ejection manifold 64. A second inline pump 104 is connected to the second main flow pipe 102 to move water from the injection manifold 46 through the pool cavity 34 to the ejection manifold 64 and back to the injection manifold 46. A plurality of mounting stands 106 attach to the first main flow pipe 98 and the second main flow pipe 102 to support the first main flow pipe 98 and the second main flow pipe 102.

A plurality of drain lines 108 extends from the drain openings 82 to drain water from the pool cavity 34. Additionally, a plurality of return lines 110 extend from the return openings 84 to return water to the pool cavity 34. At least one fill line 112 extends from the at least one fill opening 80 for connection to a water source (e.g., a water truck). A plurality of skimmer lines 114 extend from the at least one skimmer 78 for removing water from the at least one skimmer 78. A main pump 116 is connected to the drain lines 108 and the return lines 110 and the skimmer lines 114 for pumping water through the lines 108, 110, 112, 114. A main filter 118 is coupled to the main pump 116 and to the drain lines 108 and the return lines 110 and the skimmer lines 114 for filtering water flowing through the lines 108, 110, 112, 114. As shown in the Figures, the main pump 116 and main filter 118 can be disposed remotely from the pool assembly 20 (e.g., inside a utility room of the residence). A heater and/or purifier may also be used to heat and purify the water, respectively.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "compromises," "comprising," "including," and "having," are inclusive and therefore specify the presence of stated features, integers, steps, operations, elements, and/or components, but do not preclude the presence or addition of one or more other features, integers, steps, operations, elements, components, and/or groups or combinations thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptors used herein interpreted accordingly.

What is claimed is:

1. A pool assembly, comprising:

a pool body having a floor and a first side wall and a second side wall, each extending upwardly from said floor and an inlet wall and an exit wall, each extending between said first side wall and said second side wall, and each extending upwardly from said floor to define a pool cavity for containing water;

said pool body including an injection manifold disposed in said inlet wall for providing a flow of water into said pool cavity and an ejection manifold disposed in said exit wall for removing the flow of water from said pool cavity; and a stairway and seat subassembly disposed in said pool cavity and being porous and defining a plurality of openings uniformly distributed thereabout for allowing the flow of water to pass through said stairway and seat subassembly.

2. The pool assembly as set forth in claim 1, wherein the flow of water is generally centered in said pool cavity and spaced from said side walls to allow for the water in the pool cavity to remain substantially stationary adjacent said side walls.

3. The pool assembly as set forth in claim 1, wherein said injection manifold has an inlet back plate and an inlet peripheral wall extends circumferentially around said inlet back plate to define an inlet flow opening and said inlet back plate defines at least one injection opening.

4. The pool assembly as set forth in claim 3, wherein said inlet peripheral wall includes an inlet lip extending around said inlet flow opening in a spaced relationship with said inlet back plate and extending around said inlet peripheral wall and wherein said injection manifold further includes at least one inlet flow plate removably attached to said inlet lip in said inlet flow opening for directing the flow of water through said injection manifold.

5. The pool assembly as set forth in claim 4, wherein said at least one inlet flow plate defines a plurality of circular inlet apertures extending therethrough.

6. The pool assembly as set forth in claim 4, wherein said at least one inlet flow plate defines at least one elongated slot extending therethrough.

7. The pool assembly as set forth in claim 1, wherein said ejection manifold has an ejection back plate and an ejection peripheral wall extends circumferentially around said ejection back plate to define an ejection flow opening and said ejection back plate defines at least one ejection opening.

8. The pool assembly as set forth in claim 7, wherein said ejection peripheral wall includes an ejection lip extending around said ejection flow opening in a spaced relationship with said ejection back plate and extending around said ejection peripheral wall and wherein said ejection manifold further includes at least one ejection flow plate removably attached to said ejection lip in said ejection flow opening for directing the flow of water through said ejection manifold.

9. The pool assembly as set forth in claim 1, wherein said injection manifold is disposed in an injection opening defined by a sleeve attached to said inlet wall.

10. The pool assembly as set forth in claim 1, wherein said floor defines a drain aperture.

11. The pool assembly as set forth in claim 1, wherein said stairway and seat subassembly is disposed adjacent said exit wall in front of said ejection manifold and extending between said first wall and said second wall for allowing the flow of water to pass therethrough and into said ejection manifold.

12. The pool assembly as set forth in claim 1, wherein said stairway and seat subassembly includes a stairway portion disposed adjacent said first side wall and having a plurality of steps of decreasing height leading from said exit wall toward said floor and said stairway and seat subassembly includes a seat portion extending from said stairway portion toward said second side wall and including a plurality of seating platforms of decreasing height leading from said exit wall toward said floor.

13. The pool assembly as set forth in claim 12, wherein at least one of said stairway portion and said seat portion is constructed of mesh and said plurality of openings include a plurality of mesh openings.

14. The pool assembly as set forth in claim 13, further including at least one seat support coupled to and disposed under said plurality of seating platforms of said seat portion of said stairway and seat subassembly.

15. The pool assembly as set forth in claim 12, wherein said stairway portion and said seat portion is constructed of a porous material.

16. The pool assembly as set forth in claim 1, further including at least one main flow pipe extending along said pool body outside said pool cavity from said injection manifold to said ejection manifold and at least one inline pump coupled to said at least one main flow pipe to move water from said injection manifold through said pool cavity to said ejection manifold and back to said injection manifold.

17. The pool assembly as set forth in claim 1, further including at least one skimmer for removing floating debris from a surface of the water in said pool cavity.

18. A pool assembly, comprising:

a stairway portion including a plurality of steps of decreasing height and being porous and defining a plurality of openings uniformly distributed thereabout for allowing a passage of water through said stairway portion; and a seat portion disposed adjacent said stairway portion and including a plurality of seating platforms of decreasing height and being porous and defining a plurality of openings uniformly distributed thereabout for allowing the passage of water through said seat portion.

19. The pool assembly as set forth in claim 18, wherein at least one of said stairway portion and said seat portion is constructed of mesh and said plurality of openings include a plurality of mesh openings.

20. The pool assembly as set forth in claim 19, further including at least one seat support coupled to and disposed under said plurality of seating platforms of said seat portion of said stairway and seat subassembly.

21. The pool assembly as set forth in claim 18, wherein said stairway portion and said seat portion is constructed of a porous material.

22. The pool assembly as set forth in claim 18, further including a pool body having a floor and a first side wall and a second side wall, each extending upwardly from said floor and an inlet wall and an exit wall, each extending between said first side wall and said second side wall, and each extending upwardly from said floor to define a pool cavity for containing water.

23. The pool assembly as set forth in claim 22, wherein said pool body includes an injection manifold disposed in said inlet wall for providing a flow of water into said pool cavity and an ejection manifold disposed in said exit wall for removing the flow of water from said pool cavity.

24. A pool assembly, comprising:

a pool body having a floor and a first side wall and a second side wall, each extending upwardly from said floor and an inlet wall and an exit wall, each extending between said first side wall and said second side wall, and each extending upwardly from said floor to define a pool cavity for containing water;

said pool body including an injection manifold disposed in said inlet wall for providing a flow of water into said pool cavity and an ejection manifold disposed in said exit wall for removing the flow of water from said pool cavity;

said side walls of said pool body defining at least one skimmer opening and a skimmer is disposed in said at least one skimmer opening for removing floating debris from a surface of the water with said pool cavity;

said side walls of said pool body defining a plurality of drain openings coupled to a plurality of drain lines to drain water from said pool cavity and at least one fill opening coupled to at least one fill line for connection to a water source;

a stairway and seat subassembly disposed in said pool cavity and being porous and defining a plurality of openings uniformly distributed thereabout for allowing the flow of water to pass through said stairway and seat subassembly;

said stairway and seat subassembly including a stairway portion having a plurality of steps of decreasing height; and said stairway and seat subassembly including a seat portion disposed adjacent said stairway portion and including a plurality of seating platforms of decreasing height.

25. The pool assembly as set forth in claim 24, wherein the flow of water is generally centered in said pool cavity and spaced from said side walls to allow for the water in the pool cavity to remain substantially stationary adjacent said side walls.

26. The pool assembly as set forth in claim 24, wherein said injection manifold has an inlet back plate and an inlet peripheral wall extends circumferentially around said inlet back plate to define an inlet flow opening and said inlet back plate defines at least one injection opening.

27. The pool assembly as set forth in claim 26, wherein said inlet peripheral wall includes an inlet lip extending around said inlet flow opening in a spaced relationship with said inlet back plate and extending around said inlet peripheral wall and wherein said injection manifold further includes at least one inlet flow plate removably attached to said inlet lip in said inlet flow opening for directing the flow of water through said injection manifold.

28. The pool assembly as set forth in claim 27, wherein said at least one inlet flow plate defines a plurality of circular inlet apertures extending therethrough.

29. The pool assembly as set forth in claim 27, wherein said at least one inlet flow plate defines at least one elongated slot extending therethrough.

30. The pool assembly as set forth in claim 24, wherein said ejection manifold has an ejection back plate and an ejection peripheral wall extends circumferentially around said ejection back plate to define an ejection flow opening and said ejection back plate defines at least one ejection opening.

31. The pool assembly as set forth in claim 30, wherein said ejection peripheral wall includes an ejection lip extending around said ejection flow opening in a spaced relationship with said ejection back plate and extending around said ejection peripheral wall and wherein said ejection manifold further includes at least one ejection flow plate removably attached to said ejection lip in said ejection flow opening for directing the flow of water through said ejection manifold.

* * * * *